United States Patent [19]

Heintz et al.

[11] 4,104,840

[45] Aug. 8, 1978

[54] METAL BUILDING PANEL

[75] Inventors: Dennis Ronald Heintz, Oak Creek; Arthur Bertram Thelen, Brookfield, both of Wis.

[73] Assignee: INRYCO, Inc., Melrose Park, Ill.

[21] Appl. No.: 758,015

[22] Filed: Jan. 10, 1977

[51] Int. Cl.[2] ..... E04C 2/36

[52] U.S. Cl. ..... 52/309.9; 52/404; 52/595

[58] Field of Search ..... 52/309.9, 595, 483, 52/235, 489, 492, 520, 521, 404

[56] References Cited

U.S. PATENT DOCUMENTS

| | | | |
|---|---|---|---|
| 3,372,520 | 3/1968 | Hensel | 52/595 |
| 3,479,073 | 11/1969 | Collins | 52/595 |
| 3,535,844 | 10/1970 | Glaros | 52/309.9 X |
| 3,667,180 | 6/1972 | Tischuk | 52/309.9 |
| 3,706,172 | 12/1972 | Keith | 52/595 X |
| 3,714,747 | 2/1973 | Curran | 52/309.9 X |
| 3,777,430 | 12/1973 | Tischuk | 52/309.9 |
| 3,797,190 | 3/1974 | Widdowson | 52/595 |
| 3,998,024 | 12/1976 | Frandsen | 52/595 |

FOREIGN PATENT DOCUMENTS

| | | | |
|---|---|---|---|
| 600,772 | 4/1948 | United Kingdom | 52/595 |

*Primary Examiner*—J. Karl Bell

*Attorney, Agent, or Firm*—Merriam, Marshall & Bicknell

[57] ABSTRACT

Disclosed are novel building face panels, liner panels, wall panels and wall structures made from such panels. The wall panel is made from a face panel metal skin and a liner panel metal skin separated by an insulating core, such as of rigid polyurethane foam. The panels have novel male and female edges which facilitate assembling the panels into wall structures. Fasteners extend through the female edges of the wall panels securing the inner and outer metal skins to a supporting means such as girts thereby holding them together against negative pressure and fire.

10 Claims, 20 Drawing Figures

FIG. 14
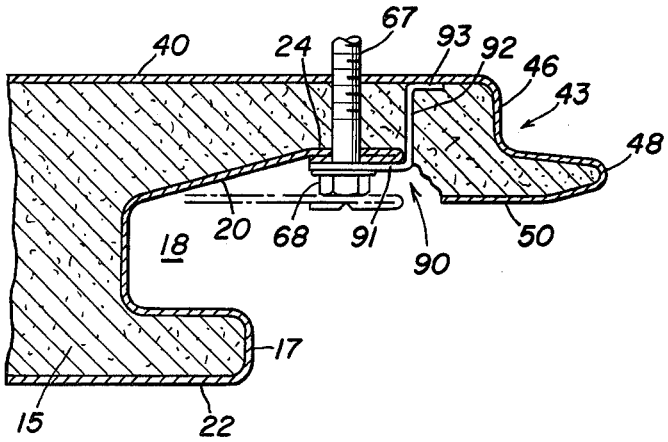
FIG. 15
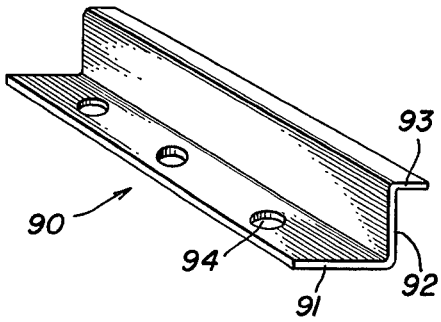
FIG. 16
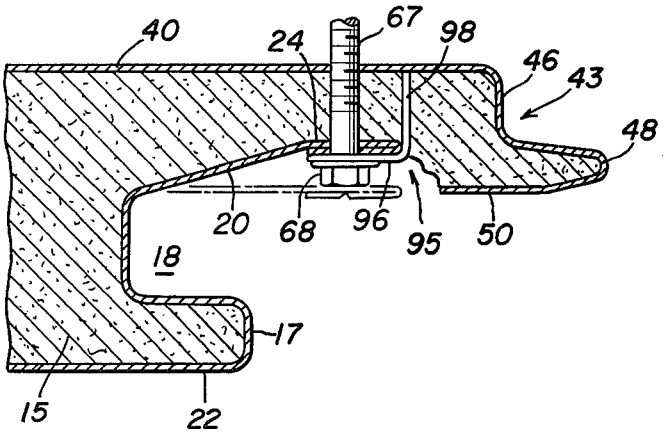
FIG. 17
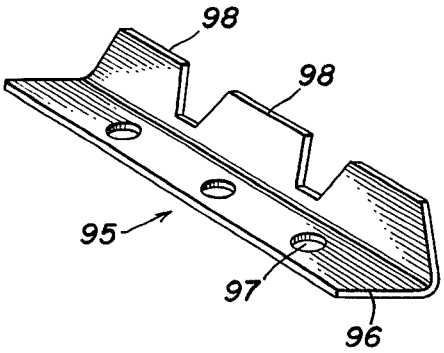
FIG. 18
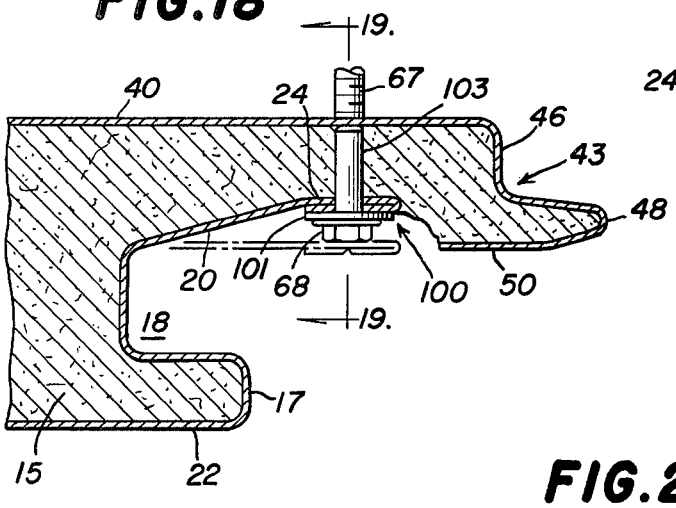
FIG. 19
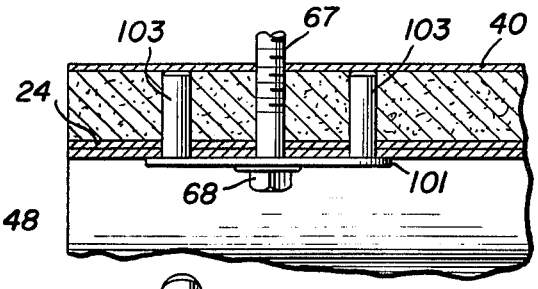
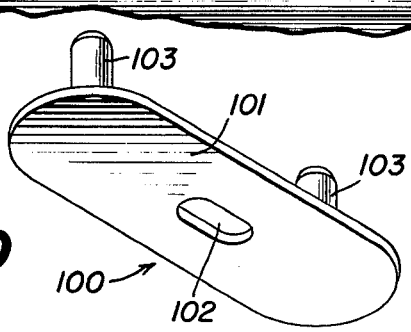
FIG. 20

METAL BUILDING PANEL

This invention relates to prefabricated construction materials used in buildings and related structures. More particularly, this invention is concerned with building panels which are suitable for use as face panels, liner panels and wall panels.

Various types of building panels have already been disclosed in the prior art and are commercially available. Glaros U.S. Pat. No. 3,535,844 discloses a double tongue and groove building panel formed of a sheet metal skin having an insulating core. The front and back walls and side edges of the panel are covered by a sheet metal skin so that the structure may be suitably employed as a wall panel. The opposing side edges of the panel are symmetrical when each edge is viewed straight on. The panels thus may be joined so as to have the front wall of one panel adjoining the front wall of the adjacent panel, or adjoining the rear wall of the adjacent panel. Another type of building panel having a double skin with symmetrical side edges for joining adjacent panels together is disclosed by Tischuk U.S. Pat. No. 3,667,180. Panels with opposing symmetrical side edges are not always desirable because such panels may be joined together incorrectly with the back face of one panel adjacent to the front face of an adjoining panel. More importantly, however, improved side joint structures are desired which will permit a more ready nesting and joining together of the panels. It is also desirable that the metal skins of a double skinned building panel be so shaped that each skin with an insulating core can be used for different purposes, as for example, one skin may be used together with an insulating core for a liner panel while the other metal skin may be used for a face panel.

As is shown in the Tischuk Patent 3,667,180, an angle clip is used to secure the outer facing of the panel to a subgirt. A screw or the like goes through the clip and through the inner facing into the subgirt. The screw does not go through the outer facing itself. As a result, when a wall made of such panels is subjected to a maximum negative pull-off load, such as is applied on the downwind side of a building during a windstorm, there is a strong tendency for the outer facing to slide out from under the clip. This same undesirable result may be expected if a fire load is applied to the outside of an exterior wall of a building made of such panels and fastened to subgirts with the described clip system.

According to one aspect of the present invention there is provided a wall panel which has a front wall made from a metal skin which extends partially around each longitudinal edge of the panel and a rear or back wall made of a sheet metal skin which also extends partially around the longitudinal edges of the panel. An insulating core is positioned between the opposing sheet metal skins and by adherence to the skins forms a rigid composite wall panel. Each side edge of the wall panel has a double tongue and groove structure, but the tongue and groove structure on one side edge is not symmetrical with the double tongue and groove structure on the other side edge of the wall panel. Furthermore, the sheet metal skins are not symmetrical to each other nor are the side edges on each panel symmetrical to one another. Also, one of the metal skins may be used by itself in conjunction with an insulating core as a face panel, while the other metal skin together with an insulating core may be used as a liner panel. One main difference between the resulting face panel and liner panel is in the thickness, with the face panel generally being more than one inch thick while the liner panel will generally be less than one inch thick.

A face panel provided according to the invention has an elongated rectangular sheet metal skin forming a front wall and male and female longitudinal side edges thereon and an insulating core. The female side edge has a groove defined by opposing walls parallel to the panel front wall. One groove wall and the panel front wall portion adjacent thereto but spaced therefrom define a tongue which ends at the top of the groove wall. The other groove wall consisting of a sheet metal layer extends outwardly substantially beyond the groove top as a panel female side edge extension. The male side edge of the face panel has a longitudinal wall which projects laterally inwardly from the panel front wall, then forwardly parallel to the panel front wall, then laterally inwardly and then slantedly backwardly to terminate at the panel back, thereby defining a tongue adapted to nest in the groove at the female side edge of an adjoining identical panel. The insulating core is advisably a polymeric rigid foam having a substantially planar rear surface, parallel to the front wall or face, which may be uncovered by the sheet metal skin but which is desirably covered by a moisture barrier, suitably aluminum foil.

The liner panel provided by the invention is elongated and rectangular in shape. It has a sheet metal skin forming a front wall and male and female side edges with an insulating core therebetween. The male side edge is designed to be nestable with the female side edge of an identical panel. The female side edge of the liner panel has a wall which projects laterally inwardly from the front wall, the side edge then is slanted forwardly to a terminal nose, then reverses direction and projects first slantedly backwardly and then about parallel to the front wall and terminates with an edge at least about at the laterally inward wall at the female side edge, thereby forming a tongue with sloped sides spaced inwardly from the metal skin front wall. The male side edge has a wall which projects laterally inwardly, then the side edge extends backwardly parallel to the front wall of the metal skin, then laterally inwardly again and then forwardly parallel to the front wall of the metal skin to extend and terminate beyond the lateral inwardly projecting wall at the male side edge. The insulating core of the liner panel may also be made of a polymeric rigid foam and be uncovered by the sheet metal skin but covered by a suitable moisture barrier.

The described sheet metal skins may be employed together to make a sheet metal double covered wall panel by placing the skins so as to have the open or trough-like side of each skin facing the open or trough-like side of the other skin. The side edges of each skin are directed towards the side edges of the other skin, although offset sidewardly of each other in a general shiplap construction. The space between the two metal skins is filled by an insulating core. A sheet metal covered wall panel so produced has substantially planar spaced apart front and back walls, an insulating core and two longitudinal spaced apart male and female side edges with each side edge having a longitudinal groove spaced between the panel front and back walls. The groove at the female side edge has opposing walls parallel to the panel walls, with one groove wall and the panel front wall portion adjacent thereto defining a first tongue which ends at the top of the groove wall, and with the other groove wall extending outwardly substantially beyond the groove top as the inner wall of a panel side edge extension further defined by a portion of the panel back wall, said panel female side edge extension terminating in a tongue offset inwardly from the panel back wall and tapered on both sides. The groove at the male side edge has opposing walls parallel to the panel walls, with one groove wall and the panel back wall portion adjacent thereto defining a first tongue which ends at the top of the groove wall, and with the other groove wall extending outwardly substantially beyond the groove top as the inner wall of a panel side edge extension further defined by a portion of the panel front wall, said panel male side edge extension terminating in a second tongue offset inwardly from the panel front wall, and said tongue having a tapered inner wall and being dimensioned to fit in the groove on the first side edge of a second identical panel. The second tongue on the male side edge is dimensioned to fit in the groove on the female side edge of a second identical panel and the tapered tongue on the female side edge is dimensioned to fit in the groove on the male side edge of the second identical panel.

Longitudinal continuous gaps are advisably provided in the sheet metal covering and are located in the inner walls of the wall panel side edge extensions on both the male and female side edges, and the adjoining gaps of joined nesting male and female side edges of two panels at least partially coincide thereby avoiding a metal path for heat flow at the joint. The sheet metal edges at at least some of the gaps are hemmed or doubled back for added strength. Desirably, the sheet metal edge of the gap in the inner wall of the panel female side edge extension closest to the groove is hemmed and drilled periodically for panel fasteners which extend through the hem and through the panel back wall into a girt. In this way the panel front and back walls are securely joined together by the fastener. When a fastener is driven into the girt it bends in or deforms the adjacent portion of the female side edge extension towards the panel back wall and simultaneously compresses the foamed core by the fastener. The fasteners may have either integral spacing means or the fasteners may be used in combination with separate spacing means. The spacing means, when used, limits the extent of bending or deformation of the female side edge extension. Also, the gap on the male side edge is desirably dimensioned to extend over the hemmed edge on the female side edge of two joined and nesting panels.

The double covered wall panel is characterized by improved structural properties, fire performance and superior air/water infiltration values. The wall panel performs well as a wall during a fire because the foam core is enclosed and is protected against fire exposure.

The invention also includes assembled wall structures made from the face panels, liner panels and wall panels, and fasteners and spacers used in joining the wall panels to girts in a novel way to make wall structures of the wall panels.

The invention will be described further in conjunction with the attached drawings, in which:

FIG. 14 is like FIG. 8 but shows a fourth type of spacer which may be used in joining the wall panel to a girt;

FIG. 15 is an isometric view of the spacer shown in FIG. 14;

FIG. 16 is like FIG. 8 but shows a fifth type of spacer which may be used in joining the wall panel to a girt;

FIG. 17 is an isometric view of the spacer shown in FIG. 16;

FIG. 18 is like FIG. 8 but shows a sixth type of spacer which may be used in joining the wall panel to a girt;

FIG. 19 is a sectional view taken along the line 19—19 of FIG. 18; and FIG. 20 is an isometric view of the spacer shown in FIGS. 18 and 19.

So far as is practical the same elements or parts which appear in the various views of the drawings will be illustrated by the same numbers.

Figure 1:
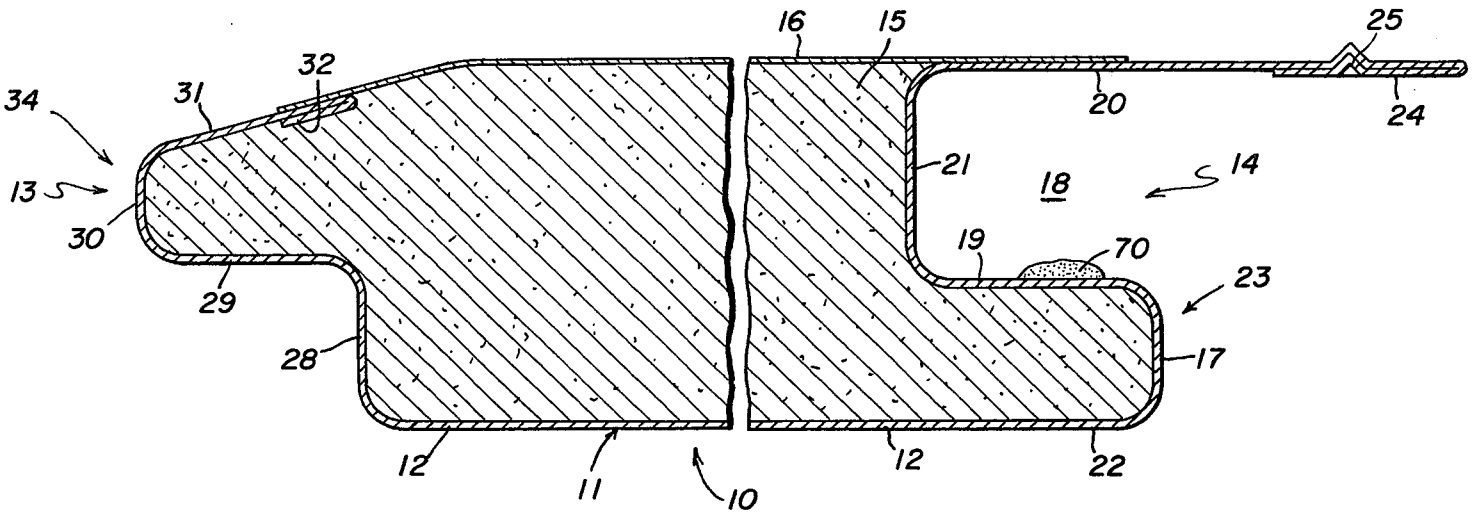
FIG. 1 is a lateral sectional view through a longitudinal rectangular face panel provided by the invention.
Figure 2:
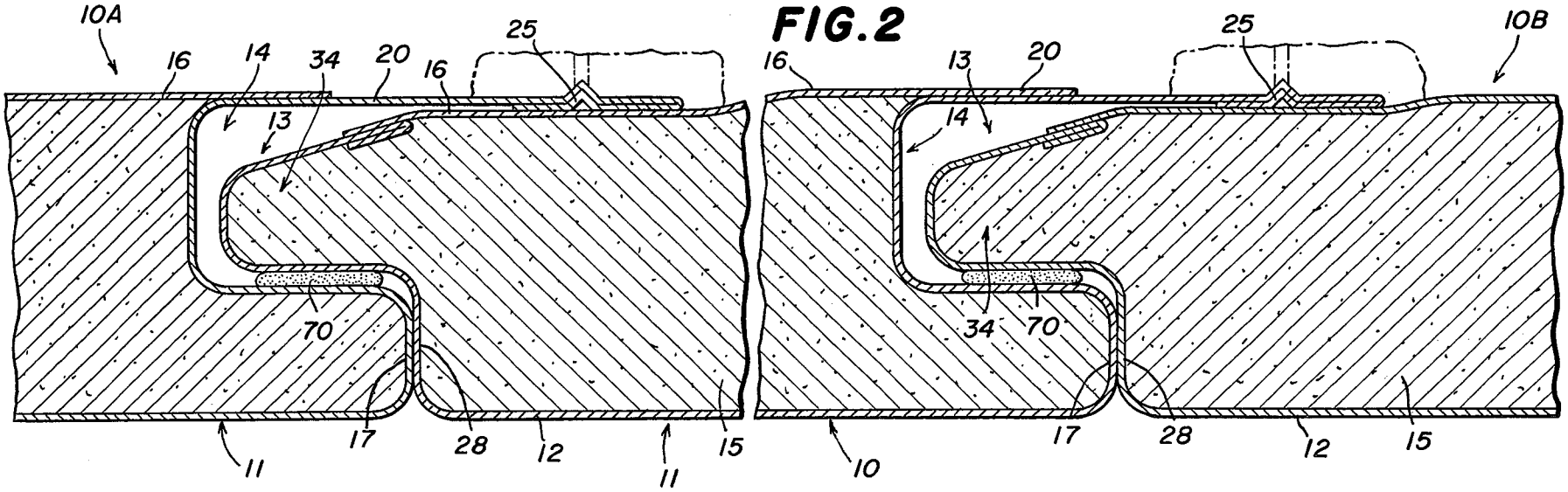
FIG. 2 is a sectional view showing three of the panels of FIG. 1 joined together.

With reference to FIGS. 1 and 2 the face panel 10 has a sheet metal skin 11 which forms a panel front wall 12, longitudinal male side edge 13 and female side edge 14. The space between the front wall and the male and female side edges 13 and 14 is filled with an insulating core 15 which may be made of any suitable material but is advisably made of a polymeric rigid foam, such as polyurethane foam. The back panel face is shown left open or uncovered by the sheet metal skin but is nevertheless almost always covered over its substantially planar or flat surface with a moistureproof barrier or film 16, such as one made of aluminum foil with or without a lamination thereon of a polymeric film. The back panel face may, however, be covered with a sheet metal skin.

The female side edge 14 of the metal skin 11 has a groove 18 having opposing walls 19 and 20 of sheet metal. The wall or bottom 21 of groove 18 joins walls 19 and 20 integrally. The groove wall 19 is parallel to the panel front wall portion 22, which together with the laterally inwardly directed wall 17 completes the three sides of tongue 23. The groove wall 20 extends substantially outwardly beyond the top of the groove 18 and as shown in the drawings is hemmed 24 by doubling back the sheet metal. Indentations 25 are provided in the hemmed portion for fasteners to more readily penetrate the metal to fasten the face panel in position. Caulking material bead 70 is deposited on groove wall 19 to provide a tight joint when two of the face panels are joined together edge-to-edge.

The male side edges 13 of face panel 11 shown in FIGS. 1 and 2 has a longitudinal wall 28 which projects laterally inwardly from the panel front wall 12, and then forwardly to form a tongue wall 29 parallel to the front wall 12, then laterally inwardly to form the end wall or nose 30 of tongue 34. The third wall 31 of the tongue 34 extends from the front wall 30 slantedly backwardly to terminate more or less at the panel back. The male side edge terminates at the end of slanted wall 31 in a hem 32 formed by doubling back the sheet metal.

FIG. 2 illustrates how three face panels 10, 10A and 10B, identical with each other and with the panel shown in FIG. 1, are joined together with the male side edges 13 nesting in the nonsymmetrical female side edge 14.

Figure 3:
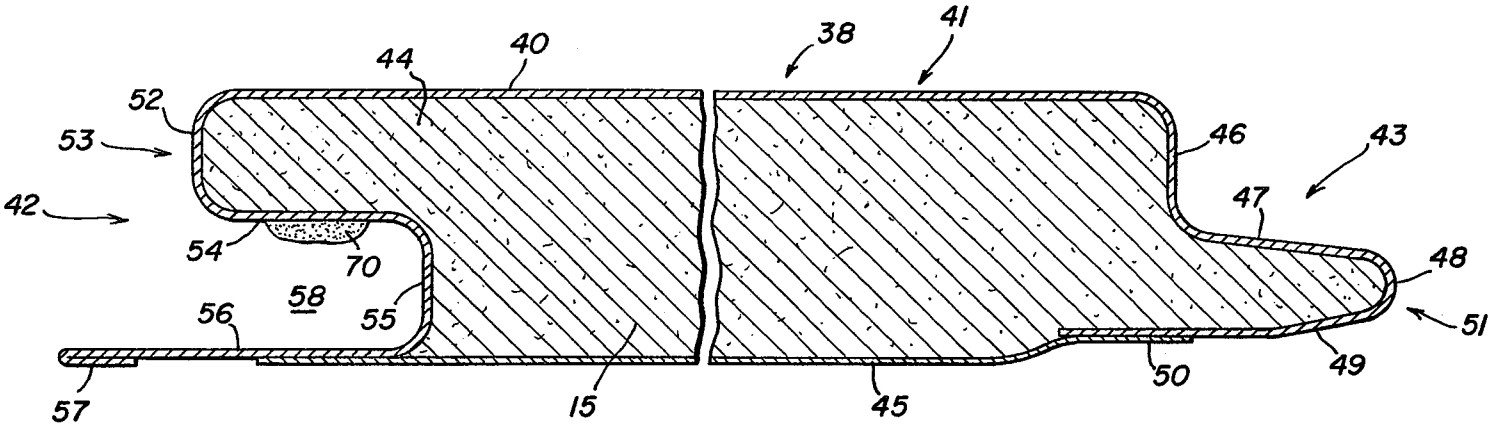
FIG. 3 is a lateral sectional view through a longitudinal rectangular liner panel.
Figure 4:
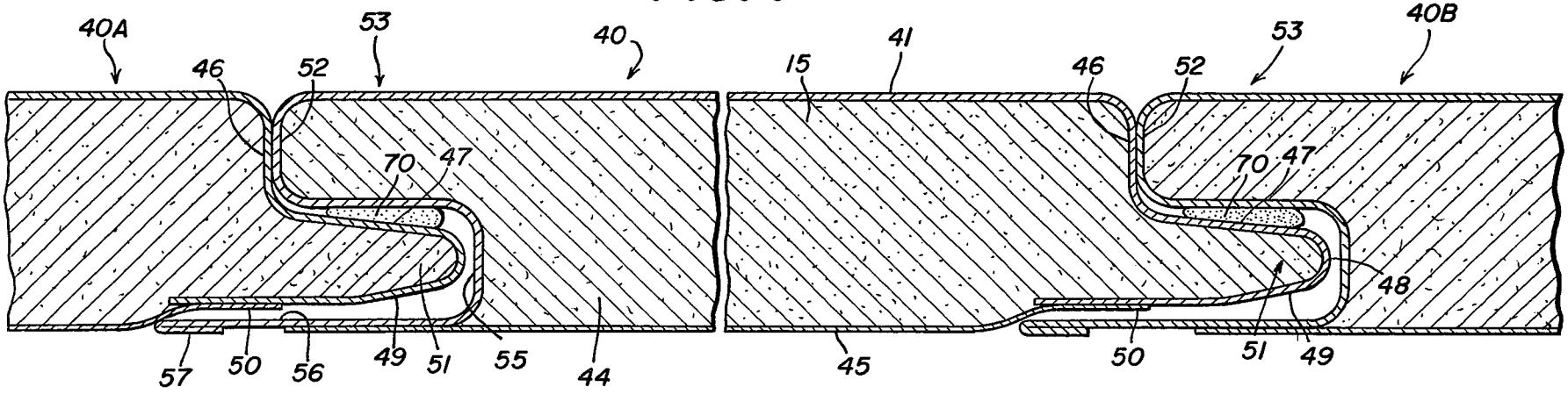
FIG. 4 is a sectional view showing three of the panels of FIG. 3 joined together.

FIGS. 3 and 4 illustrate an elongated rectangular liner panel 38 which comprises a sheet metal skin 40 which provides a panel front wall 41, a male side edge 42 and a female side edge 43 with an insulating core 44 in the space defined by the sheet metal skin 40. The back of the panel is left uncovered by the sheet metal skin 40 but instead the planar or flat surface of the insulating core 44 is covered with a moisture barrier 45, such as aluminum foil.

The female side edge 43 has a wall 46 which projects laterally inwardly from the front wall 41 and then slants forwardly as wall 47 to a terminal nose 48 from which the sheet metal skin then reverses direction and projects first as a backwardly slanted wall 49 and then to a wall 50 which is about parallel to the front wall 41. The wall 50 will generally terminate at or beyond the lateral wall 46 and as shown in FIG. 3 the wall portion 50 extends considerably therebeyond.

The male side edge 42 of the liner panel shown in FIG. 3 has a wall 52 which projects laterally inwardly from the front wall 41 and forms the front of a tongue 53. Wall 54 extends from the front wall 52 to the wall or bottom 55 of groove 58. A bead of caulking material 70 is placed on wall 54 to obtain a tight joint when two liner panels are joined together edge-to-edge. The bottom 55 extends to wall 56 which projects outwardly beyond the top wall 52 of tongue 53 and advisably terminates in a hem 57 formed by doubling back the sheet metal. The walls 54 and 56 together with the bottom 55 define groove 58 into which the tongue 51 at the female side edge nests when adjoining panels are put together.

FIG. 4 illustrates how the liner panel 40 of FIG. 3, and liner panels 40A and 40B, which are identical to panel 40, are joined together with the nonsymmetrical male and female side edges nested together to form a joint.

Figure 6:
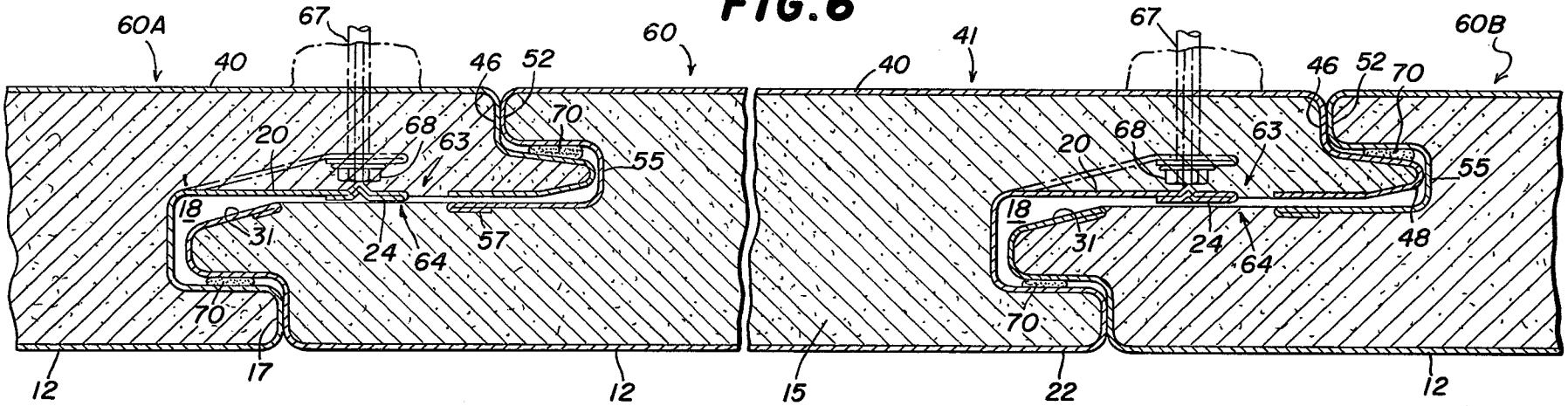
FIG. 6 is a sectional view taken along the line 6—6 of FIG. 5.
Figure 7:
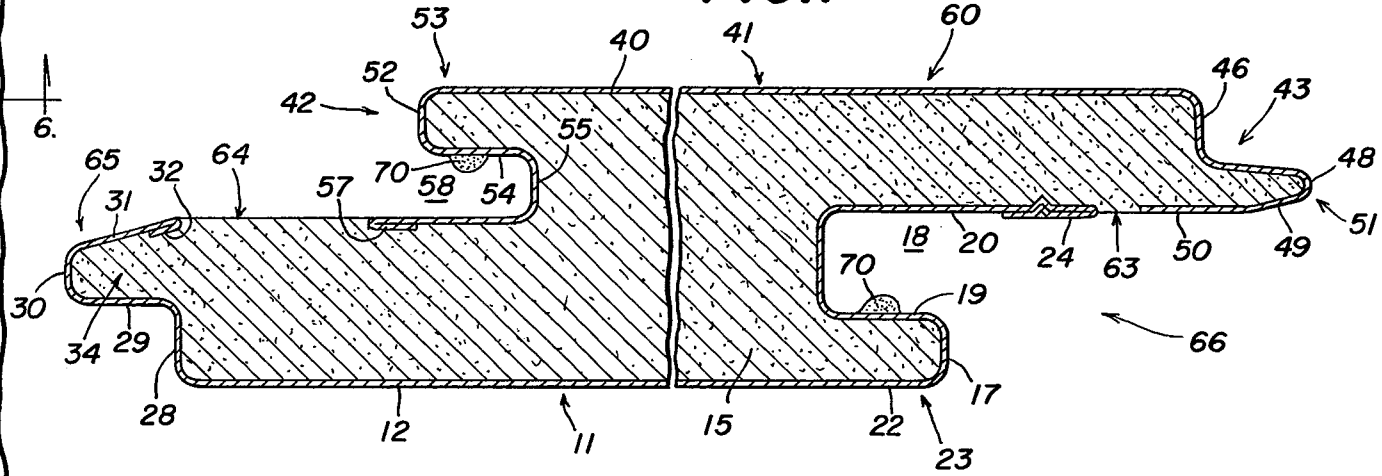
FIG. 7 is a view of the central panel of the wall structure shown in FIG. 6.
Figure 5:
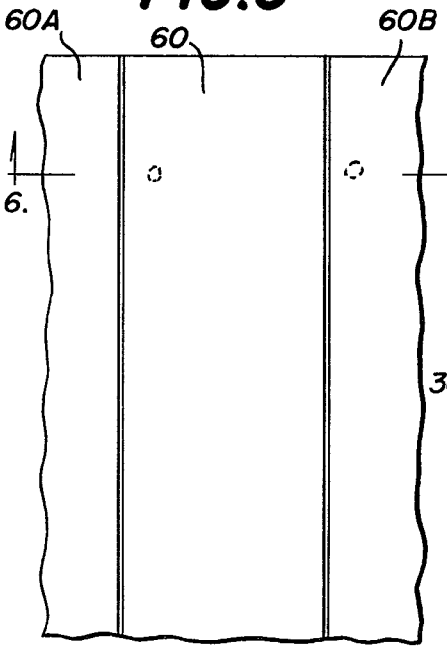
FIG. 5 is an elevational view of a wall portion made of wall panels provided by this invention.

FIGS. 5 to 7 of the drawings illustrate a wall panel, and a wall structure made therefrom, which utilizes the sheet metal skins employed in the previously described face panel of FIGS. 1 and 2 and the liner panel of FIGS. 3 and 4.

FIG. 5 is an elevational view of a wall section made of three identical wall panels 60, 60A and 60B. Each of the wall panels is shaped in the form of an elongated rectangle and may be from about 2 to 3 feet wide and from about 2 to 30 feet long. FIG. 6 shows in sectional view the joined structure of the wall portion made from the identical panels 60, 60A and 60B. Each of the panel side edges has a more or less nonsymmetrical double tongue and groove structure which nests together to form a completed wall joint.

As shown in FIG. 7 the wall panel 60 employs the metal skin 11 shown in FIG. 1 and the sheet metal skin 40 shown in FIG. 3. In the wall panel, however, of FIG. 7 the previously identified front wall 41 (FIG. 3) now constitutes the rear or back wall of the composite wall panel. The wall panel 60 is formed by positioning the open back of sheet metal skin 11 so that it faces more or less the open back of sheet metal skin 40. The edge of wall 50 is positioned to be spaced away from the hem 24, but in essentially the same plane to provide a gap 63 which is occupied by insulation. Similarly, the end of hem 32 is positioned to be essentially in the same plane as hem 57 but spaced substantially away therefrom to provide a gap 64 which is occupied by insulation. Once the metal skins 11 and 40 are positioned as shown in FIG. 7 the space which they surround can be filled by depositing fluid polymeric foam which upon expanding and setting occupies the entire space therein and forms a rigid composite wall panel. A bead 70 of a pliable sealant is deposited on wall 19 of groove 18 and wall 54 of groove 58 so that an air-tight seal is formed when the appropriate tongues are nested in the grooves.

FIGS. 6 and 7 illustrate how the wall panel 60 and two panels 60A and 60B identical thereto nest together at their side edges to form a wall structure. The male side edge 65, which is a composite of the male side edges 34 and 53, nest in the female side edge 66, which is a composite of previously described female side edges 23 and 43. The sloped or slanted sides of the tongues facilitate nesting of the side edges of two adjoining panels with good dimensional accuracy. The panels are secured in place by fasteners 67 which extend through hem 24 and through the back metal skin 40 into a suitable girt or other supporting means. This is an important feature since it helps resist negative pulloff loads by holding the face sheet mechanically to the supporting girt. It also prevents lateral movement of the outer metal skin and also prevents if from falling away from the insulation during a fire and thereby exposing the insulation. Furthermore, when the fasteners 67 are driven into a girt or supporting means the wall 20 and hem 24 are deformed (as shown in phantom in FIG. 6) in the vicinity of the fastener and pushed toward the sheet metal skin 40 with compression of the insulating core 15. This provides a rigid joint and a pocket for the fastener head 68.

The insulation gap 64 spans the insulation gap 63 when two panels are joined together, thereby avoiding a continuous metal joint through which heat could flow.

FIGS. 8 to 14 illustrate various spacers which may be used in conjunction with a fastener to secure the female end of a wall panel to a supporting means. Each spacer has for its purpose to limit the inward deformation of wall 20 and hem 24. The spacer, furthermore, is generally not needed on all wall structures but is used primarily on large wall structures which may be subjected to large negative pressure forces.

Figure 8:
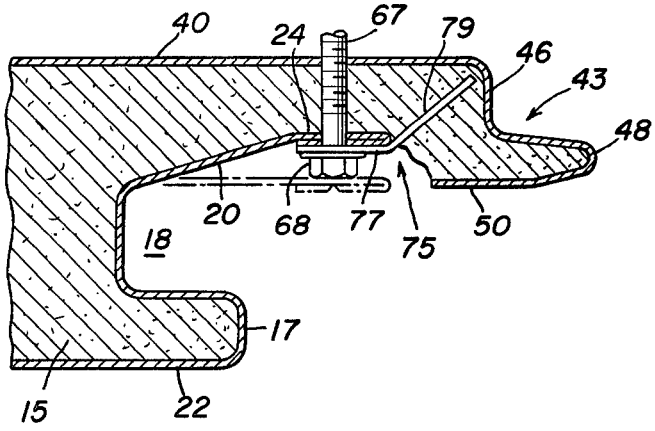
FIG. 8 is a sectional view of the female side edge of the wall panel of FIGS. 5 and 6 and shows one type of spacer which may be used in joining the wall panel to a girt.
Figure 9:
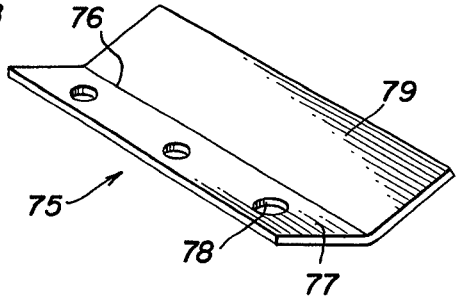
FIG. 9 is an isometric view of the spacer shown in FIG. 8.

As shown in FIGS. 8 and 9, the spacer 75 comprises a rectangular metal piece bent longitudinally to an oblique angle along the line 76. Flange 77 of the spacer has three holes 78 through which one or more fasteners 67 may extend. Flange 79 of spacer 75, when it comes in contact with sheet metal skin 40, limits the deformation of hem 24. FIG. 8 shows in phantom the location of hem 24 before it is deformed by fastener 67, and also shows the hem after it has been deformed.

Figure 10:
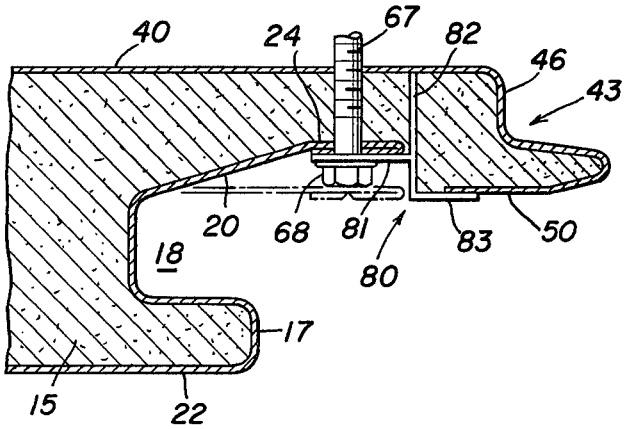
FIG. 10 is like FIG. 8 but shows a second type of spacer for making a joint.
Figure 11:
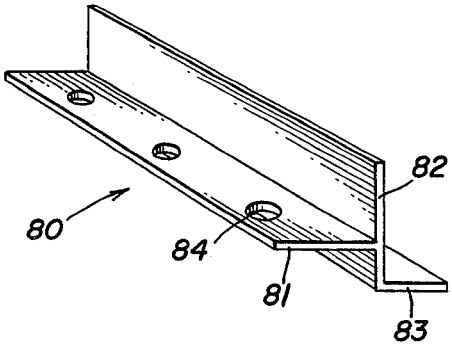
FIG. 11 is an isometric view of the spacer shown in FIG. 10.

FIGS. 10 and 11 illustrate a second spacer 80 and its use in joining the female end of a wall panel to a supporting means. The spacer 80 has a flange 81 extending laterally from flange 82 and flange 83 extends laterally from the other side of flange 82. Holes 84 receive one or more fasteners 67. Flange 81 extends over hem 24 and flange 83 projects over wall portion 50 so that these portions of the wall panel are very firmly held in place. The inward displacement of hem 24, with a corresponding compression of the panel core 15 adjacent thereto, are limited to the length of flange 82 which extends inwardly beyond flange 81. This inward displacement as shown in FIG. 10 extends from the original location of hem 24 shown in phantom to its final location shown in FIG. 10.

Figure 12:
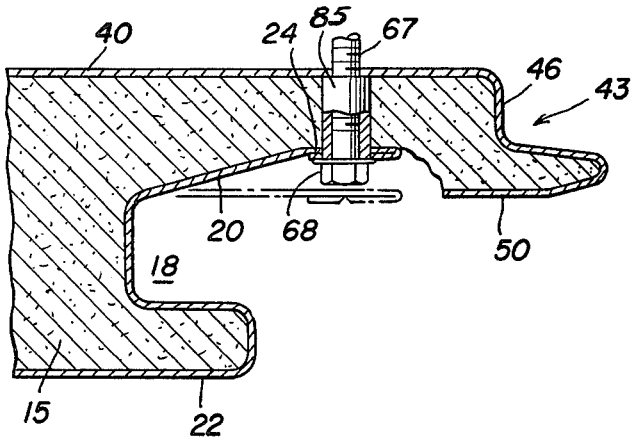
FIG. 12 is like FIG. 8 but shows a third type of spacer which may be used in joining the wall panel to a girt.
Figure 13:
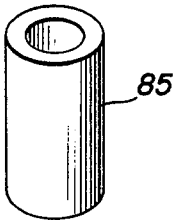
FIG. 13 is an isometric view of the spacer shown in FIG. 12.

FIGS. 12 and 13 illustrate a third spacer in the form of a short tube 85 through which fastener 67 extends. The short tube 85 has an external diameter slightly smaller than a receiving hole in hem 24 so that it can be put in position readily. A washer beneath head 68 of the fastener thus simultaneously presses hem 24 and the fastener towards metal skin 40. In this way inward deformation of the hem is effected until limited by the spacer short tube 85. Obviously, the short tube may be made an integral part of fastener 67 to thereby avoid handling an extra part.

A fourth spacer and its use are shown in FIGS. 14 and 15. The spacer 90 has a flange 91 with holes 94, a flange 92 perpendicular to flange 91, and a flange 93 perpendicular to flange 92. Flange 92 limits the inward deformation of hem 24 by fastener 67.

A fifth spacer and its use are shown in FIGS. 16 and 17. The spacer 95 has a flange 96 containing holes 97 for one or more fasteners 67, and flat-topped teeth 98 designed for ready penetration into insulating core 15. The length of teeth 98 limit the inward deformation of hem 24 by fastener 67. This is presently the preferred form of spacer.

FIGS. 18 to 20 illustrate a sixth spacer and its use. Spacer 100 has a flat plate 101 containing an elongated hole 102 for receiving fastener 67. From the back of plate 101 extend two spaced apart tubular members 103 of equal length which project through holes located in hem 24 and thus limit inward deformation of hem 24 when fastener 67 is driven into a girt or other supporting means.

The described six spacers may be used to improve resistance to negative pulloff and to maintain a fixed distance between the exterior skin and a supporting means such as a structural girt. The spacer is not needed to mechanically fasten the exterior skin to a structural girt or other supporting means.

The foregoing detailed description has been given for clearness of understanding only, and no unnecessary limitations should be understood therefrom, as modifications will be obvious to those skilled in the art.

What is claimed is:

1. A face panel having a sheet metal skin forming a front wall and male and female longitudinal side edges thereon and having an insulating core, a groove at the female side edge having opposing walls parallel to the panel front wall, with one groove wall and the panel front wall portion adjacent thereto but spaced therefrom defining a tongue which ends at the top of the groove wall, and with the other groove wall constituting a sheet metal layer extending straight outwardly substantially beyond the groove top as a panel female side edge extension, said extension being parallel to the panel front wall, and the male side edge having a longitudinal wall which projects first laterally inwardly from the panel front wall, then forwardly parallel to the panel front wall, then laterally inwardly and then extends slantedly backwardly to terminate at the panel back opposite the first lateral projection thereby defining a tongue adapted to nest in the groove at the female side edge of an adjoining identical panel.

2. A face panel according to claim 1 in which the insulating core is a polymeric rigid foam having a substantially planar panel rear surface covered by a moisture barrier.

3. A liner panel having a sheet metal skin forming a front wall and male and female side edges with an insulating core therebetween;

the male side edge being nestable with the female side edge of an identical panel, the metal skin having a female side edge wall which projects laterally inwardly from the front wall, then is slanted forwardly to a terminal nose, then reverses direction and projects first slantedly backwardly and then about parallel to the front wall and terminates with an edge at least about at the laterally inwardly wall at the female side edge, thereby forming a tongue with sloped sides spaced inwardly from the metal skin front wall, and the metal skin having at the male side edge a wall which projects laterally inwardly, then backwardly parallel to the front wall of the metal skin, then laterally inwardly and then forwardly parallel to the front wall of the metal skin to extend and terminate beyond the lateral inwardly projecting wall at the male side edge.

4. A liner panel according to claim 3 in which the insulating core is a polymeric rigid foam having a substantially planar panel rear surface uncovered by the sheet metal skin but covered by a moisture barrier.

5. A sheet metal covered wall panel having substantially planar spaced apart front and back walls, an insulating core and two longitudinal spaced apart male and female side edges, each side edge having a longitudinal groove spaced between the panel front and back walls, the groove at the female side edge having opposing walls parallel to the panel walls, with one groove wall and the panel front wall portion adjacent thereto defining a first tongue which ends at the top of the groove wall, and with the other groove wall extending outwardly substantially beyond the groove top as the inner wall of a panel side edge extension further defined by a portion of the panel back wall, said panel female side edge extension terminating in a second tongue offset inwardly from the panel back wall and tapered on both sides, the groove at the male side edge having opposing walls parallel to the panel walls, with one groove wall and the panel back wall portion adjacent thereto defining a first tongue which ends at the top of the groove wall, and with the other groove wall extending outwardly substantially beyond the groove top as the inner wall of a panel side edge extension further defined by a portion of the panel front wall, said panel male side edge extension terminating in a second tongue offset inwardly from the panel front wall, said second tongue having a tapered inner wall and being dimensioned to fit in the groove on the female side edge of a second identical panel, and said second tongue on the female side edge of the second identical panel being dimensioned to fit in the groove on the male side edge of the first identical panel.

6. A sheet metal covered panel according to claim 5 in which longitudinal continuous gaps in the sheet metal covering are present in the inner walls of the panel side edge extensions on both the male and female side edges and the adjoining gaps of joined nesting male and female side edges of two panels at least partially coincide thereby avoiding a metal path for heat flow at the joint.

7. A sheet metal covered panel according to claim 5 in which the sheet metal edges at at least some of the gaps are hemmed or doubled back.

8. A sheet metal covered panel according to claim 5 in which the sheet metal edge of the gap in the inner wall of the panel female side edge extension closest to the groove is hemmed and drilled for panel fasteners which extend through the hem and through the panel back wall.

9. A sheet metal covered panel according to claim 8 in which the gap on the male side edge extends over the hemmed edge on the female side edge of two joined and nesting panels.

10. An elongated rectangular panel having two opposing spaced apart first and second sheet metal skins with an insulating core therebetween, the panel having first and second longitudinal side edges which can nest with the first side edge of one panel in the second side edge of another panel, the first metal skin having a first longitudinal edge which projects laterally inwardly, then is slanted forwardly to a terminal nose, then reverses direction first slantedly backwardly and then about parallel to the face of the metal skin and terminates beyond the laterally inwardly projection, thereby forming a tongue with sloped sides spaced inwardly from the metal skin face, the first metal skin having a second longitudinal edge which first projects laterally inwardly, then backwardly parallel to the face of the metal skin, then laterally inwardly and then forwardly parallel to the face of the metal skin and terminates beyond the first lateral inward projection, the second metal skin having a first longitudinal edge which projects laterally inwardly, then backwardly parallel to the face of the metal skin, then laterally inwardly and then forwardly parallel to the face of the metal skin and terminates beyond the first lateral inward projection but terminates a short distance from, and in the same plane as, the terminus of the first metal skin first longitudinal edge, and the second metal skin having a second longitudinal edge which projects first laterally inwardly, then forwardly, then laterally inwardly and then reverses direction to extend slantedly backwardly to terminate in the same plane as, and spaced away from, the terminus of the first metal skin second longitudinal edge.

* * * * *